US008462059B2

(12) United States Patent
Schnuerer

(10) Patent No.: US 8,462,059 B2
(45) Date of Patent: Jun. 11, 2013

(54) VEHICLE ANTENNA

(75) Inventor: Marco Schnuerer, Pforzheim (DE)

(73) Assignee: Wilhelm Sihn jr. GmbH & Co. KG, Niefern-Öschelbronn (DE)

( * ) Notice: Subject to any disclaimer, the term of this patent is extended or adjusted under 35 U.S.C. 154(b) by 565 days.

(21) Appl. No.: 12/719,694

(22) Filed: Mar. 8, 2010

(65) Prior Publication Data

US 2010/0231467 A1 Sep. 16, 2010

(30) Foreign Application Priority Data

Mar. 10, 2009 (DE) ..... 10 2009 012 641

(51) Int. Cl.
*H01Q 1/32* (2006.01)

(52) U.S. Cl.
USPC ..... 343/715; 343/711; 343/713

(58) Field of Classification Search
USPC ..... 343/711, 713, 715
See application file for complete search history.

(56) References Cited

U.S. PATENT DOCUMENTS

| | | | | |
|---|---|---|---|---|
| 6,714,171 | B2 * | 3/2004 | Haussler et al. | 343/888 |
| 2007/0031198 | A1 | 2/2007 | Silva | |
| 2008/0122708 | A1 * | 5/2008 | Lindackers et al. | 343/713 |
| 2008/0198077 | A1 * | 8/2008 | Duzdar et al. | 343/715 |

FOREIGN PATENT DOCUMENTS

| | | | |
|---|---|---|---|
| DE | 102 10 593 | A1 | 9/2003 |
| DE | 20 2004 004 740 | U1 | 10/2004 |
| DE | 20 2007 015 890 | U1 | 2/2008 |
| DE | 20 2007 015 891 | U1 | 2/2008 |
| DE | 20 2007 015 892 | U1 | 2/2008 |
| DE | 10 2007 054 141 | A1 | 5/2009 |
| WO | WO 2006/018624 | A1 | 2/2006 |

* cited by examiner

*Primary Examiner* — Dieu H Duong

(57) ABSTRACT

The invention relates to a vehicle antenna with a bottom part, comprising a metallic base area, a top latched with the bottom part, and a printed circuit board held between the bottom part and the top and carrying at least one transmission or receiver element,
wherein the top has at least one latching hook for latching into a mounting opening of a body part.

19 Claims, 15 Drawing Sheets

VEHICLE ANTENNA

The invention relates to a vehicle antenna with a bottom part, comprising a metallic base area, a top latched with the bottom part, and a printed circuit board held between the bottom part and the top and carrying a transmission or receiver element.

It is a permanent objective in the development of vehicle antennas to render antenna production and mounting on the body part of a vehicle as simple and economical as possible. An object of the present invention therefore is to show a way of how this can be better achieved.

SUMMARY OF THE INVENTION

This problem is solved by an antenna with the features specified in claim 1. Advantageous embodiments of the invention are the subject matter of subordinate claims.

With a vehicle antenna according to the invention, a double function of a top latched with a bottom part achieves not only simple production but also easy mounting. Because the top is used, on the one hand, to hold an electric subassembly between itself and the bottom part and to fasten, on the other hand, the antenna to a body part of a vehicle.

An antenna according to the invention can thus be mounted, completely assembled, on the body part of a vehicle with an easy turn of the hand by engaging the top with one or a plurality of latching hooks into a mounting opening and latching in there. The antenna assembly can be very easily realized by the manufacturer since only three components must be connected, i.e. the bottom part, the top and the electrical subassembly, i.e. a printed circuit board with transmission or receiver elements carried thereby and possibly other electrical components. This is possible with little expenditure due to the top latching with the bottom part. Because of the fastening function of the top, advantageously no other elements or tools are required for mounting the antenna on a body part.

For latching a vehicle antenna according to the invention into a mounting opening of a body part, the latching hook or hooks can be pushed inside and, after the hook has passed the body part, spring back again towards the outside so that the vehicle antenna latches into its mounting position. By pushing the latching hook or hooks towards the inside again, latching can be undone as needed, for example, for dismounting in a service case.

The top of the antenna can be economically manufactured as a plastic injection molded part. This way, all functional elements required for latching with the bottom part and for fastening on a body part can be integrally manufactured with the top, i.e. in one piece. The bottom part can also be manufactured of plastic and metallized for providing of a metallic base area, for example by applying a metal film. But the bottom part can also be manufactured of metal, by casting for example.

In addition to one or a plurality of transmission or receiver element(s), the printed circuit board may carry an antenna circuit with more or less complex electrical or electronic components. With antennas, the transmission as well as the receiver elements are generally called radiators although a radiator only used for reception does not emit any radiation in operation, thus does not radiate. A uniform designation for transmission elements and receiver elements is sensible, however, since transmission elements with a corresponding circuit can also be used for reception and receiver elements can also be used for transmission.

An advantageous embodiment of the invention provides that the bottom part laterally extends beyond the top. It is here preferable that the bottom part has, on opposite sides, a strip which laterally extends beyond the top.

Another advantageous embodiment of the invention provides that the top has a stop, preferably a plurality of stops, for abutting on the edge of the mounting opening. It is here preferable that the stops effect a minimum space between the body part having the mounting opening and an area of the bottom part laterally extending beyond the top.

Another advantageous embodiment of the invention provides that the top has spring elements which laterally push, in mounted condition, against the edge of a mounting opening. It is here preferable that at least some of the spring elements bear a latching hook.

Another advantageous embodiment of the invention provides that the top has a slot by means of which a transmission or receiver element carried by the printed circuit board is clamped. It is here preferable that the slot extends between resiliently movable wall sections which extend between two slittings formed in the top.

Another advantageous embodiment of the invention provides that the printed circuit board sits on positioning elements of the bottom part, on pins for example. This way, the antenna manufacture can be advantageously simplified.

Another advantageous embodiment of the invention provides that the printed circuit board is clamped in between the bottom part and the top. For example, the top can have spring supports which press onto the printed circuit board.

Another advantageous embodiment of the invention provides that the top has spring elements which, in assembled condition, laterally press against the edge of a mounting opening. The spring elements preferably form a part of the outside wall of the top. By the spring elements being limited on opposite sides by means of slittings in the top, resilient mobility can be provided in a simple manner. The slittings preferably extend perpendicularly to the bottom part of the vehicle antenna.

The present invention furthermore relates to a system with a vehicle antenna according to the invention and an antenna cover for sticking onto a body part, as well as a body part with a vehicle antenna according to the invention which is mounted thereon, with one mounting opening of the body part having, on its edge, clearances for spring arms with latching hooks of the vehicle antenna.

BRIEF DESCRIPTION OF THE DRAWINGS

Further details and advantages of the invention are explained by exemplary embodiments with reference to the enclosed drawings. Identical and matching parts are designated with corresponding reference symbols. It is shown in.

DETAILED DESCRIPTION

Figure 1:
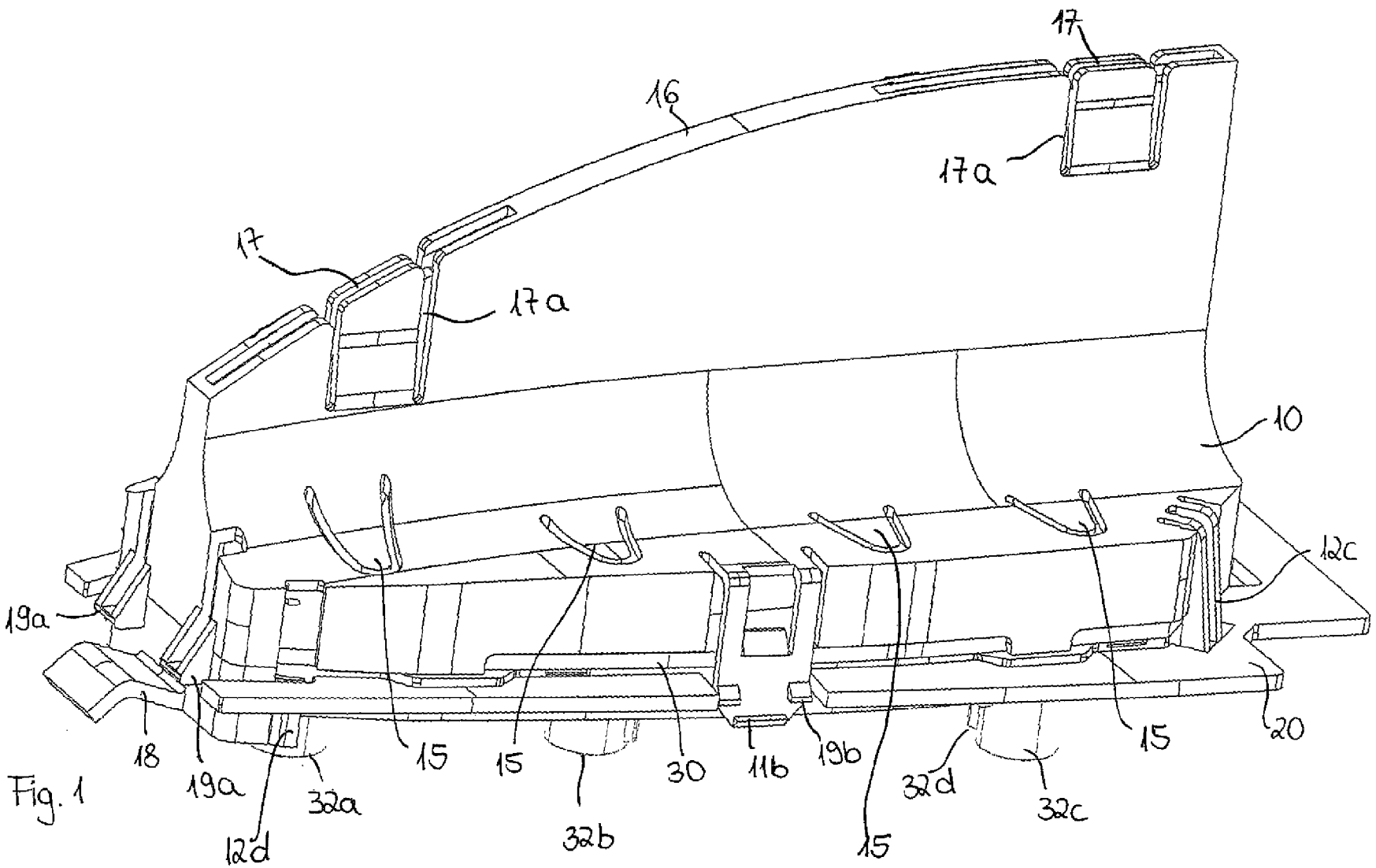
FIG. 1 an exemplary embodiment of a vehicle antenna according to the invention.
Figure 2:
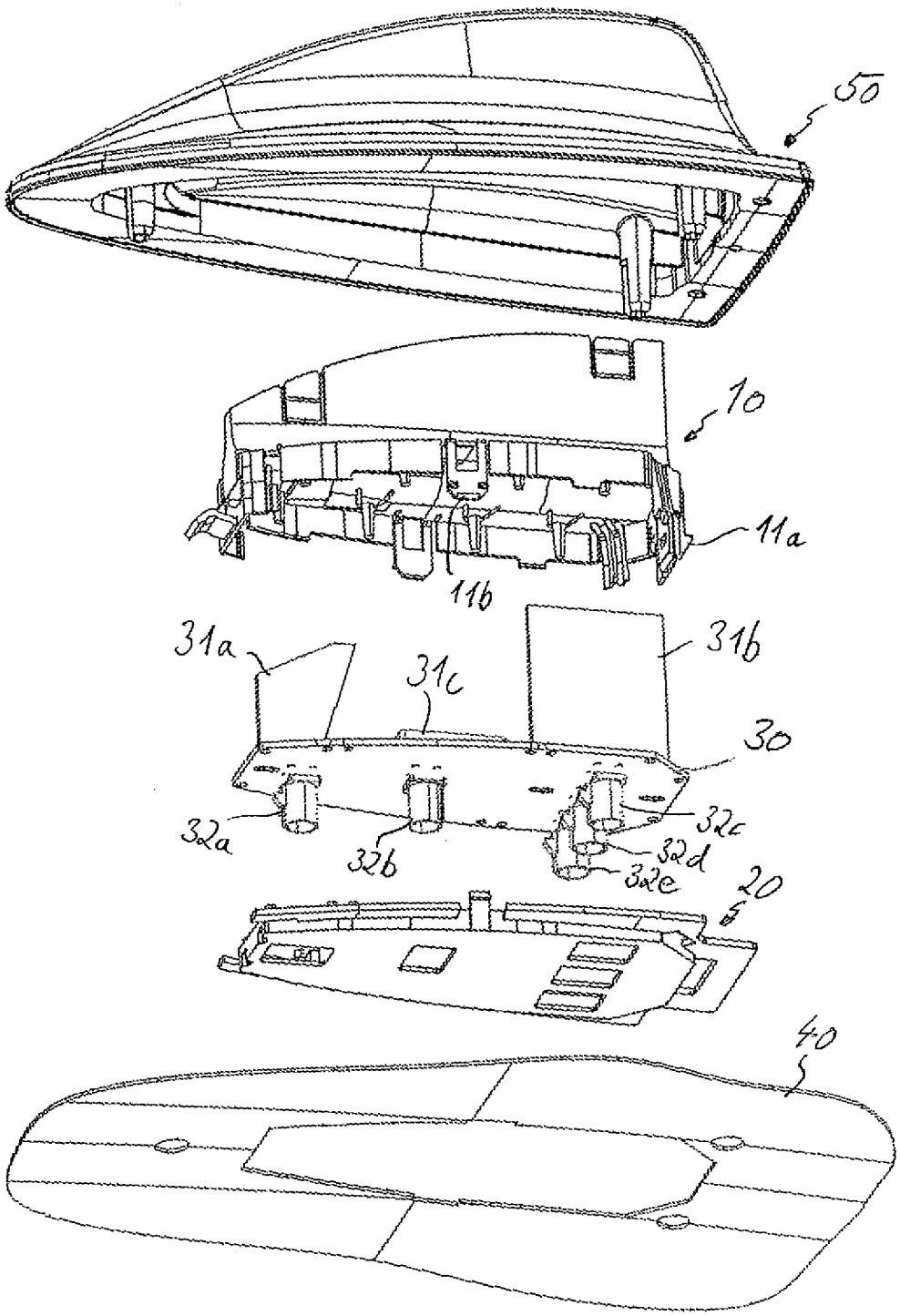
FIG. 2 an explosion drawing of the vehicle antenna with cover and body part.
Figure 4:
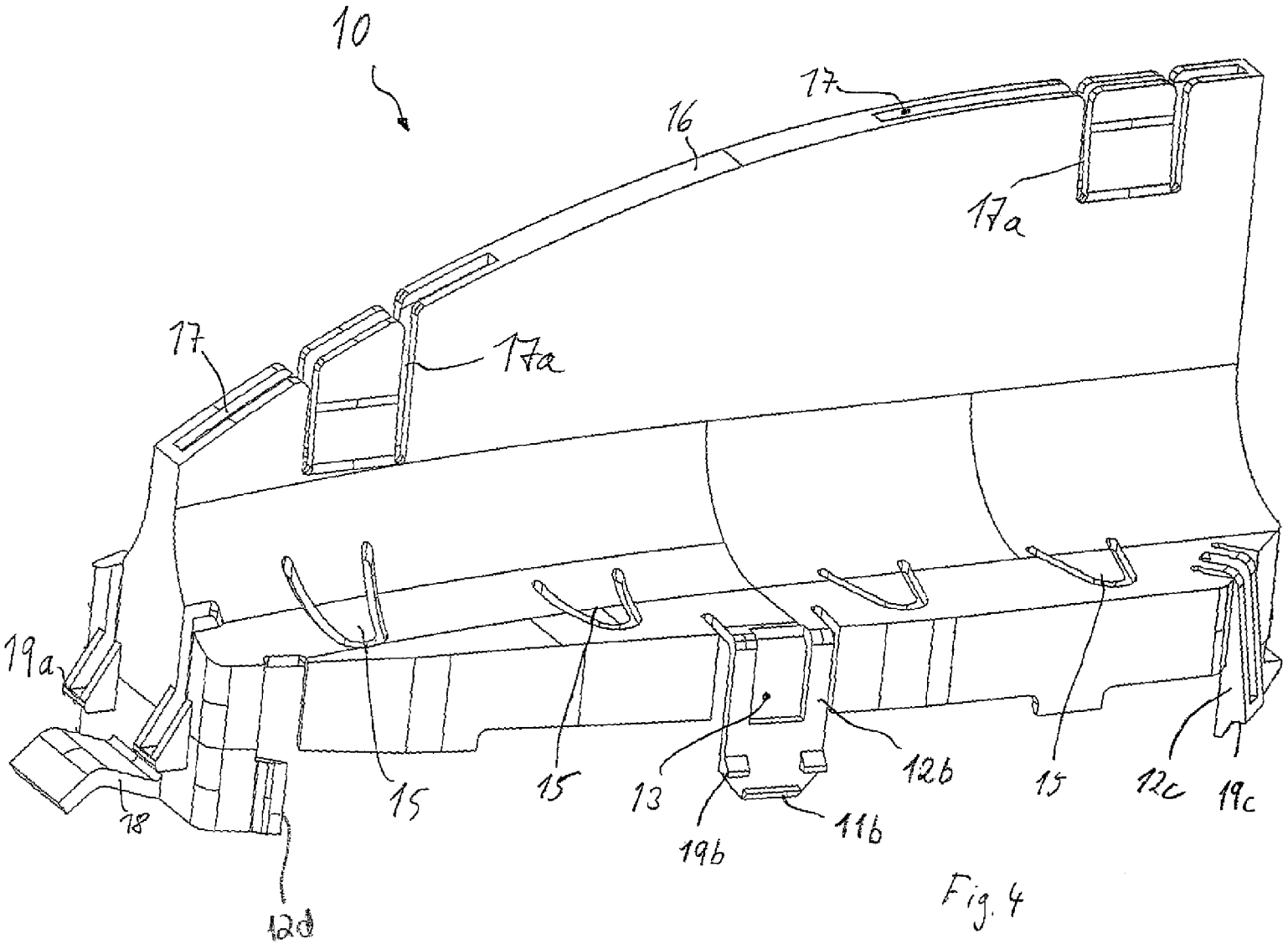
FIG. 4 the top of the vehicle antenna.
Figure 5:
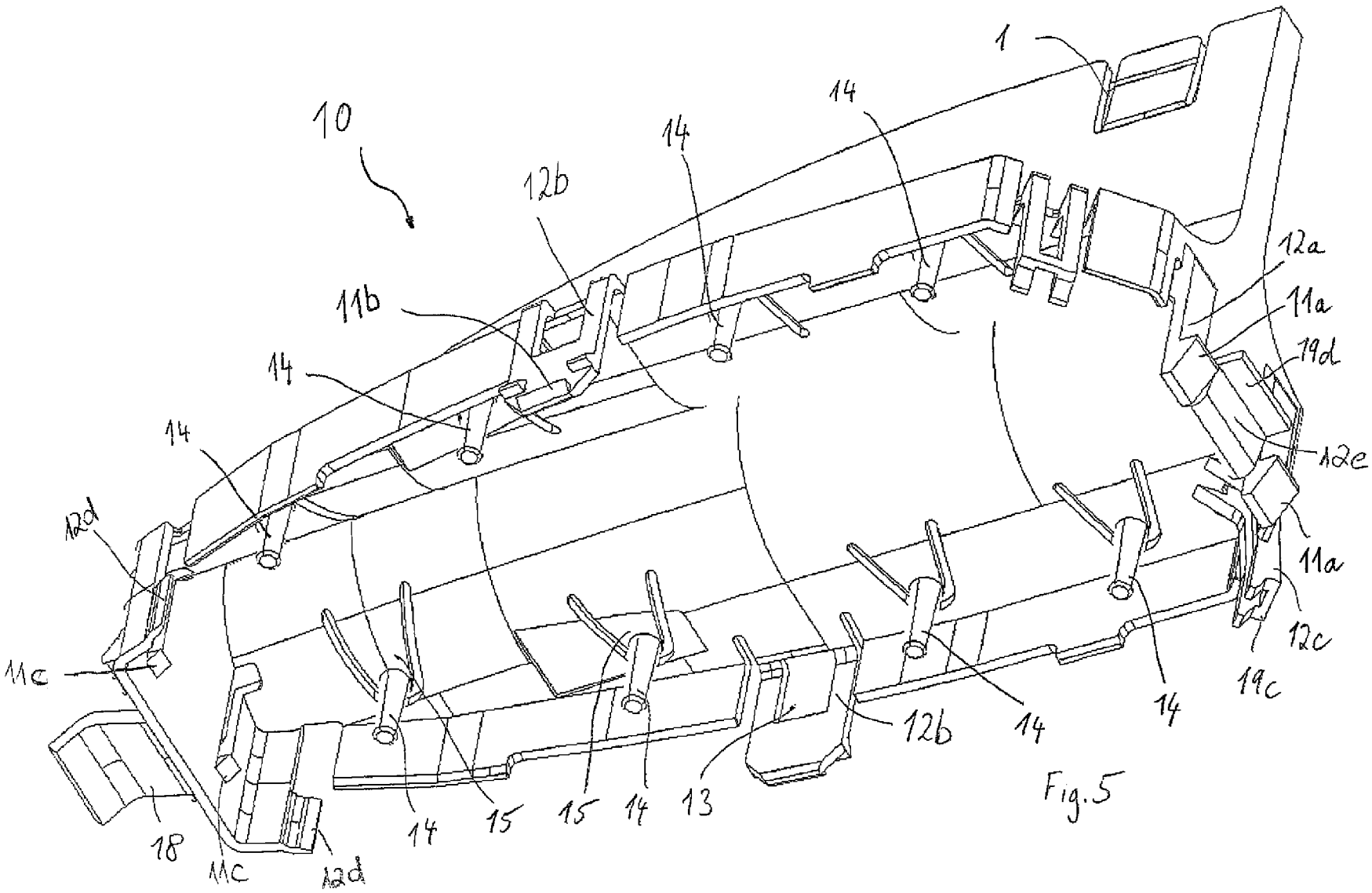
FIG. 5 another view of the top.
Figure 6:
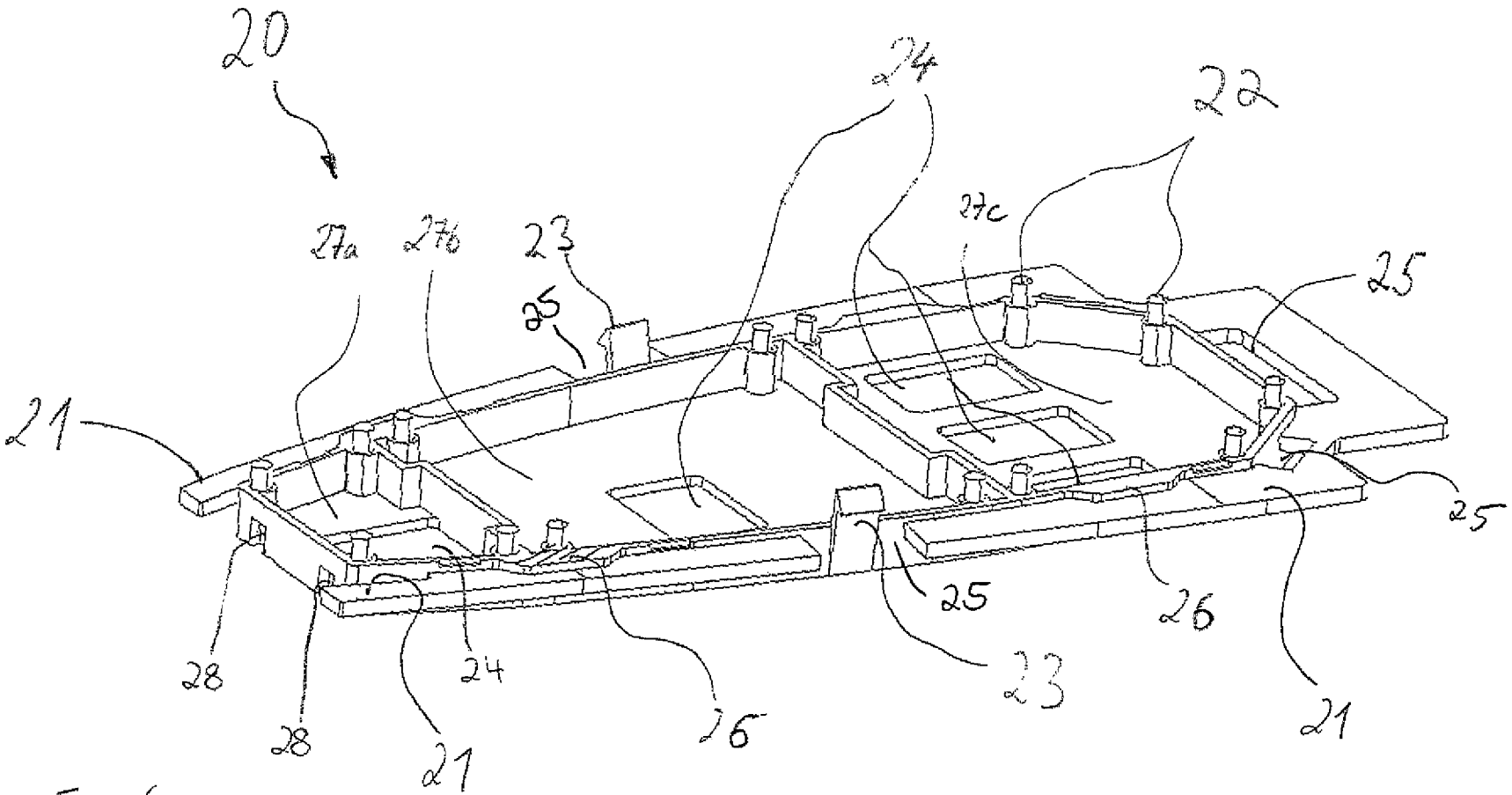
FIG. 6 the bottom part of the vehicle antenna.
Figure 7:
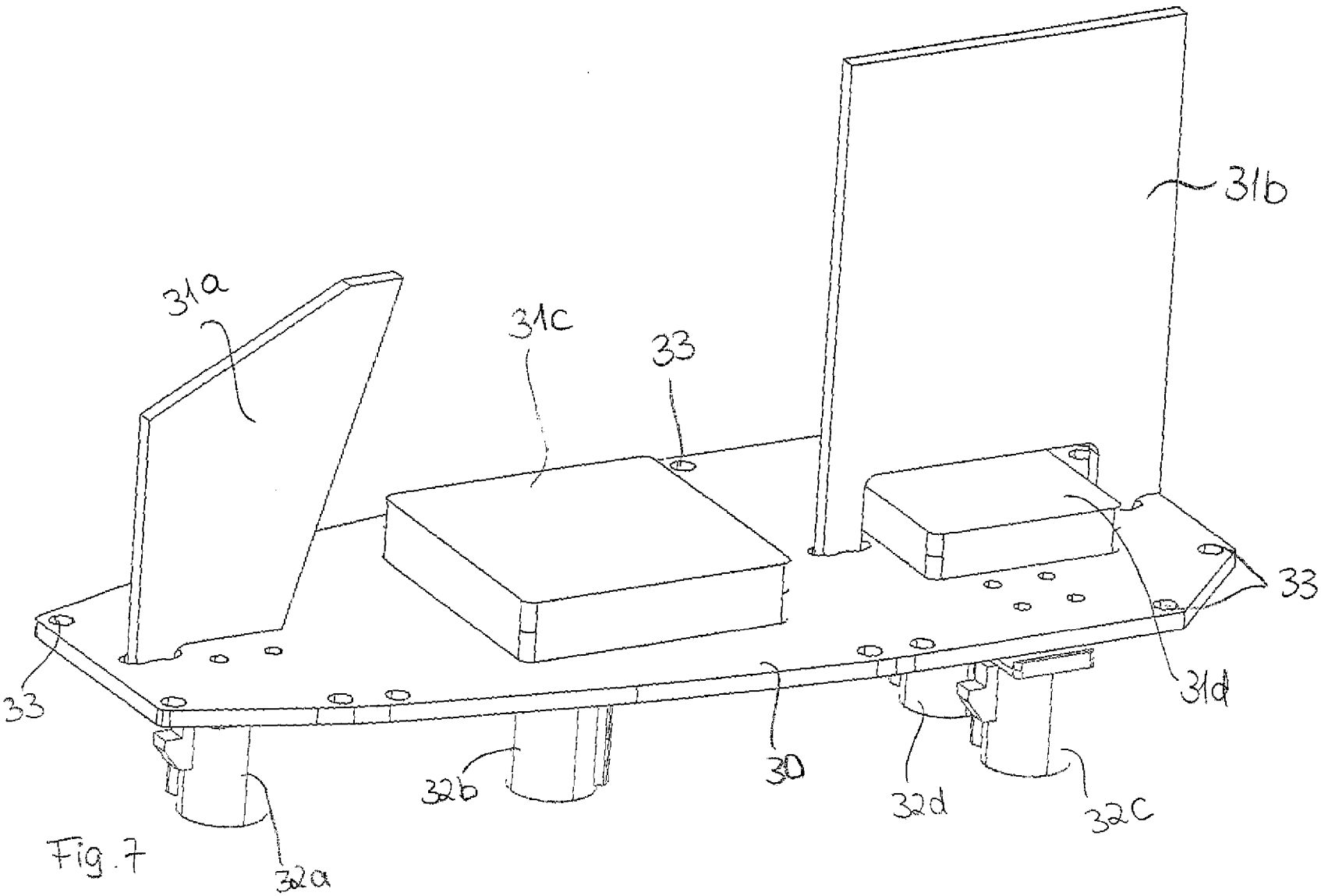
FIG. 7 the electrical subassembly of the vehicle antenna.

The vehicle antenna shown in FIG. 1 consists of a top 10 shown in FIGS. 4 and 5, a bottom part 20 shown in FIG. 6 and an electrical subassembly shown in FIG. 7 which comprises a printed circuit board 30 and radiators 31*a*-31*d* and plug-in connectors 32*a*-32*e* carried by said board. After assembly from the components shown in FIG. 2, the vehicle antenna is inserted into a mounting opening of a body part 40 and topped by a cover 50 which is stuck onto the body part 40. The cover 50 protects the mounted vehicle antenna and prevents any penetration of moisture into the interior of the vehicle. The cover 50 has no mechanical connection to the vehicle antenna.

The top 10 is an injection molded part of plastic and has a plurality of latching hooks 11*a*, 11*b* for latching into a mounting opening of a body part 40. The latching hooks 11*a*, 11*b* are arranged on spring arms 12*a*, 12*b* so that the force required for pushing into a mounting opening is reduced. The spring arms 12*a*, 12*b* form spring elements which, in mounted condition, laterally push against the edge of the mounting opening and advantageously effect a tolerance compensation as well as a clamping of the vehicle antenna in the body opening. In the exemplary embodiment shown, the top 10 has further spring elements 12*c*, 12*e* which, after mounting, also press against the edge of the mounting opening but do not carry any latching hooks. The spring elements 12*c* are designed as spring arms; spring element 12*e* is designed as a spring shackle. Spring elements can be advantageously designed as part of the outside wall of the top 10. Slittings in the top 10 on both sides of a spring element can provide in a simple manner for its resilient mobility.

Figure 3:
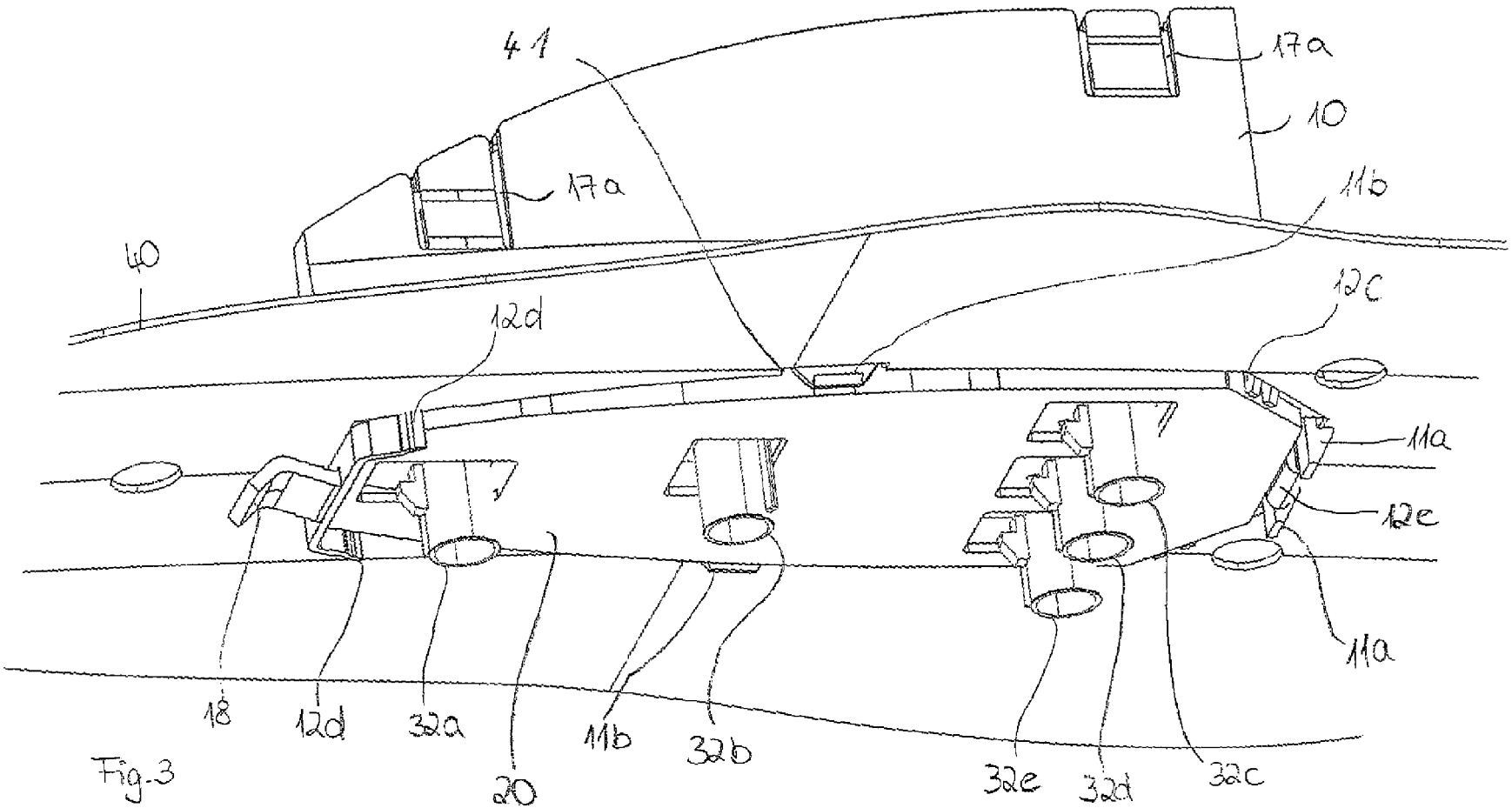
FIG. 3 the vehicle antenna after mounting on a body part from below.

As shown in FIG. 3, the mounting opening of the body part 40 has, on its lateral edge, clearances 41 for the spring arms 12*b* of the top. The latching hooks 11*b* are advantageously protected in this manner against unlatching on their own.

The top 10 latches with the bottom part 20 and has latching elements 13 provided for this. These latching elements 13 are designed as latching openings in the exemplary embodiment shown and are preferably arranged in spring elements 12*b*, particularly in the spring arms of the latching hooks 11*b*.

In the exemplary embodiment shown, the top 10 rests on the bottom part 20, i.e. with edge sections, and surrounds as a housing the printed circuit board 30 or printed circuit boards. In principle, however, it is also possible that the top 10 sits on the printed circuit board 30 and clamps it with the top's edge between itself and the bottom part 20. In the exemplary embodiment shown, the printed circuit board 30 is clamped between the bottom part 20 and the top 10 by the top 10 having spring supports 14 which bear down on the printed circuit board 30. The spring supports 14 can extend, for example, from resiliently movable clips or straps 15 of the top 10. Suitable straps can be formed, for example, by U- or C-shaped cuts or clearances in a housing wall of the top 10.

Additionally, the top 10 clamps plate-shaped radiators 31*a*, 31*b* which are carried by the printed circuit board 30 and are shown particularly in FIG. 7. The top 10 has a hollow fin 16 into which extend the plate-shaped radiators 31*a*, 31*b*. For improvement of the clamping, fin 16 has a slot 17 extending in longitudinal direction, thus in the plane of the plate-shaped radiators 31*a*, 31*b*. By means of slittings 17*a* extending transversely to the longitudinal direction, the resilient mobility of wall sections on both sides of the slot 17 can be improved. Moreover, fin 16 enables easy handling of the vehicle antenna when mounting it.

In the exemplary embodiment shown, the elongated top 10 on one end has a clamping strap 18 which is pushed, for mounting, under the edge of a mounting opening and is put under bending stress in a subsequent swivel movement of the vehicle antenna resulting in the latching hooks 11*a*, 11*b* being latched in. The clamping strap 18 can be provided with a kink or a bend to increase its tension force. On its end facing the clamping strap 18, the top 10 has the above described latching hooks 11*a* which latch into the mounting opening at the end of the swivel movement. As the clamping strap 18 is under bending stress, tolerance differences can be compensated and an adjustment to differently curved vehicle roofs can be achieved. Advantageously, the clamping strap 18 in combination with the latching hook or hooks 11*a*, 11*b* can produce a mechanical tension which prevents any clattering or rattling of the vehicle antenna.

The top 10 preferably has a plurality of stops 19*a*-19*d* for setting onto the body part 40 having the mounting opening. The stops 19*a*-19*d* effect a minimum space between the body part 40 and the strip 21 of the bottom part 20, said strip laterally extending beyond the top 10. A contact between the bottom part 20 and the body part 40 can thus be prevented by means of the stops 19*a*-19*d*. The bottom part 20 can therefore be in capacitive coupling with the body part 40. In the exemplary embodiment shown, stops are arranged on some of the spring elements, i.e. the stops 19*b* and 19*c* on spring arms 12*b* or 12*c*, respectively, as well as additionally on both ends of the top 10, i.e. the stops 19*a* and 19*d*.

To exclude a contact between the front end of the bottom part 20 and the body part 40, the top has wings 12*d* which cover the edge of the bottom part. In the exemplary embodiment shown, the clamping strap 18 extends from the wings 12*d* which embrace as clamping wings the bottom part 20.

Furthermore, the top 10 has two interior hooks 11*c* which engage in openings 28 of the bottom part 20 in FIG. 6. The latching hooks 11*c* are designed as projections on the inside of the top 10 and are preferably not resilient.

The bottom part 20 of the vehicle antenna shown in FIG. 6 is a die cast part, for example of a zinc or aluminum alloy. This way, the bottom part 20 forms a metallic base area which has openings 24 for the plug-in connectors 32*a*-32*e* shown in FIG. 7. The bottom part 20 has positioning elements 22 which the printed circuit board 30 can be slipped on and thus be unambiguously positioned with reference to the bottom part 20. In the exemplary embodiment shown, the positioning elements 22 are cylindrical pins; however, they may actually be shaped in any way matching the corresponding holes or cutouts of the printed circuit board 30.

As already described in connection with the top 10, the bottom part 20 latches with the top 10 and has latching hooks 23 for this which engage in matching latching openings 13 of the top 10, as well as openings 28 in which the latching hooks 11*c* of the top 10 engage.

To improve the mechanical stability of the latching, an additional latching hook 23 can be set on the rear end of the bottom part 20 in front of the clearance 25 which engages into a matching opening of the top 10 and there latches additionally. Generally, all spring, latching, and support elements can be optimally designed in terms of the mechanical forces by changing their geometric design as well as by the addition of ribs or slots.

The bottom part 20 has on its edge a strip 21 on opposite sides. When the bottom part 20 is latched with the top 10, the strip 21 extends laterally beyond the top 10. With a mounted vehicle antenna, the strip 21 therefore covers the edge of the body part 40 so that an improved capacitive coupling of the bottom part 20 to the body part is possible. The above described stops 19*a*-19*d* of the top 10 here ensure that a minimum space is kept between the strip 21 and the body part 40.

The strip 21 may be designed circumferentially. Preferably, however, the bottom part 20 has clearances on its edge so that the strip 21 is broken up. The strip 21 is particularly broken up at the front end of the bottom part 20 where the clamping strap 18 extends after latching with the top 10. Advantageously, the strip 21 does not impair the mounting of the vehicle antenna wherein the clamping strap 18 is pushed under the edge of the mounting opening.

In the breaks of strip 21 on the longitudinal sides of the bottom part 20, latching hooks 23 are arranged in the clearances which engage in the latching openings 13 of the top 10. However, to increase the strip surface, clearances 25 can also be provided for the latching hooks of the top 10, as those shown at the rear end of the exemplary embodiment for the latching hooks 11*a*.

The bottom part 20 has supporting fields 26 for the top 10. The supporting fields 26 can be raised versus the strip 21 as is shown in FIG. 6. As the top 10 rests only with a small part of its edge, manufacturing tolerances can be advantageously compensated by the latching between top 10 and bottom part 20.

To protect electronic components attached to the printed circuit board 30, the bottom part 20 may have one or a plurality of hollows 27*a*-27*c* as is shown in FIG. 6. Electronic components, for example pre-amplifiers, can be attached particularly on the underside of the printed circuit board 30.

FIG. 7 shows the electrical subassembly of the vehicle antenna. The electrical subassembly is formed by a printed circuit board 30 which carries at least one radiator 31*a*-31*d* and plug-in connector 32*a*-32*e*—the exemplary embodiment shows a plurality thereof. The printed circuit board 30 additionally carries an electrical antenna circuit and can include, for example, pre-amplifiers for signal conditioning or other electronic components. The electrical subassembly preferably has only a single printed circuit board 30 as in the exemplary embodiment shown. Principally, however, a plurality of printed circuit boards can also be arranged side by side.

In the exemplary embodiment, the printed circuit board 30 carries four radiators, i.e. two plate-shaped radiators 31*a*, 31*b* which can be designed as metallized surfaces of printed circuit boards, and two patch antennas 31*c*, 31*d*. The radiators 31*a*-31*d* are preferably soldered with the printed circuit board 30; however, they can also be glued with the printed circuit board 30—especially in case of the patch antennas 31*c*, 31*d*; and they are used, for example, for radio reception (DAB), for mobile communication, for a GPS system or other systems, for example SDARS, ONDAS, ICO or CMMB.

On the underside of the printed circuit board 30, plug-in connectors 32*a*-32*e* are provided which extend, in an assembled vehicle antenna, through the openings 24 of the bottom part 20. The plug-in connectors 32*a*-32*e* have a plug-in connector housing with mechanical coding elements which prevent a mix-up of connections in the interior of the vehicle and can be designed, for example, as Fakra connectors.

The plug-in connectors 32*a*-32*e* are preferably rigidly connected to the printed circuit board 30, for example, by soldering their inner and outer conductors with the printed circuit board 30.

The openings 24 of the bottom part 20 are here dimensioned such that mating connectors, as a rule couplers, can be inserted from the vehicle line set into the hollows 27*a*, 27*b* of the bottom part so that the couplers are largely accepted, in mounted condition, by the vehicle antenna, i.e. almost up to the printed circuit board 30. The housings of the plug-in connectors 32*a*-32*e* have latching hooks for latching with the housing of a matching counterpart, e.g. a coupler. In this case, the latching hook sits in or, seen from the vehicle interior, behind the opening 24 so that the counterpart for coupling to the plug-in connector 32*a*-32*e* must penetrate into the corresponding opening 24. Advantageously, the mounting depth can be kept very small so that more head room and a better head impact protection can be achieved inside the vehicle.

So that the printed circuit board 30 can be precisely positioned on the bottom part 20, the printed circuit board 30 has holes 33 for the positioning elements 22 of the bottom part.

Figure 8:
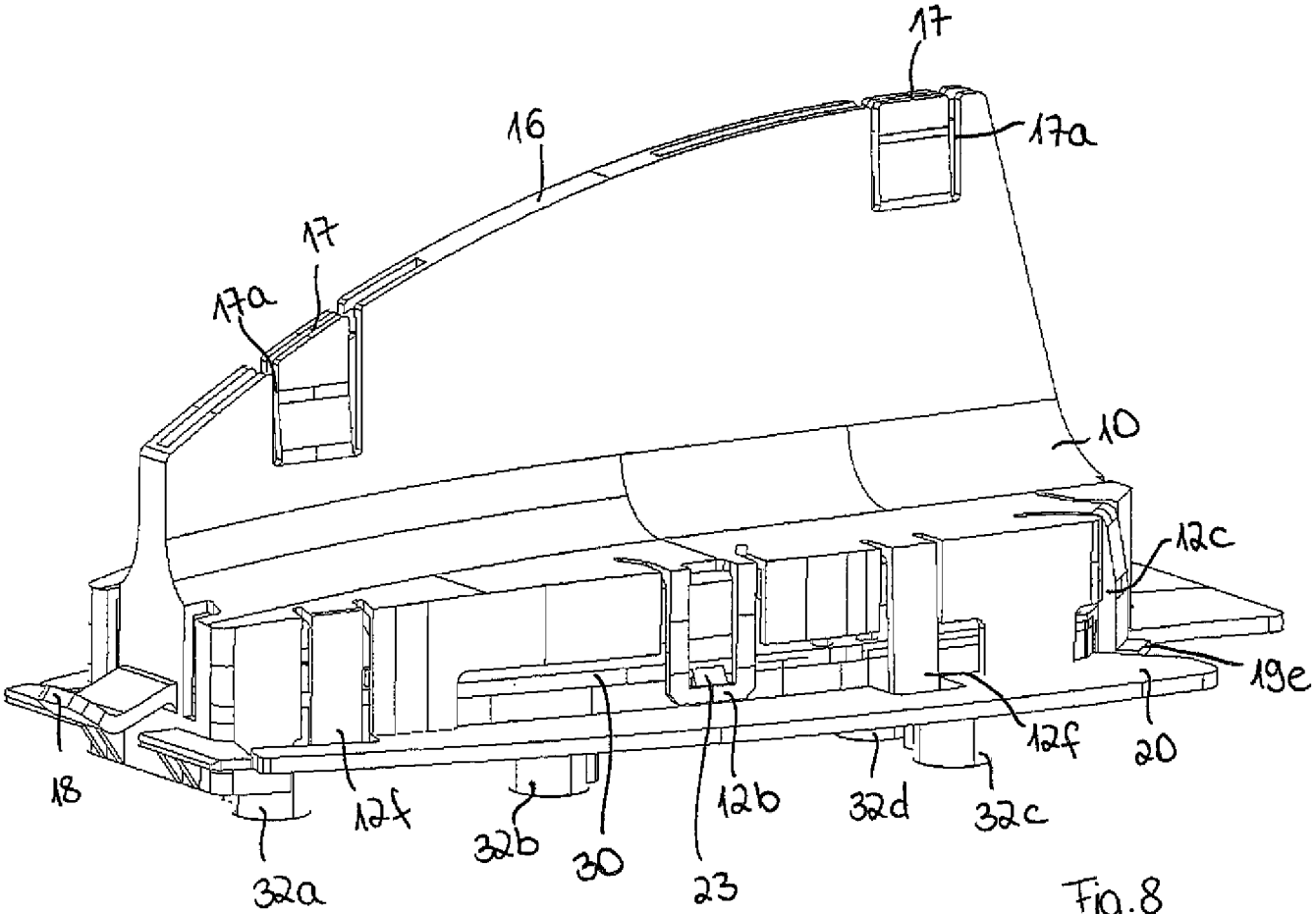
FIG. 8 another exemplary embodiment of a vehicle antenna according to the invention.
Figure 9:
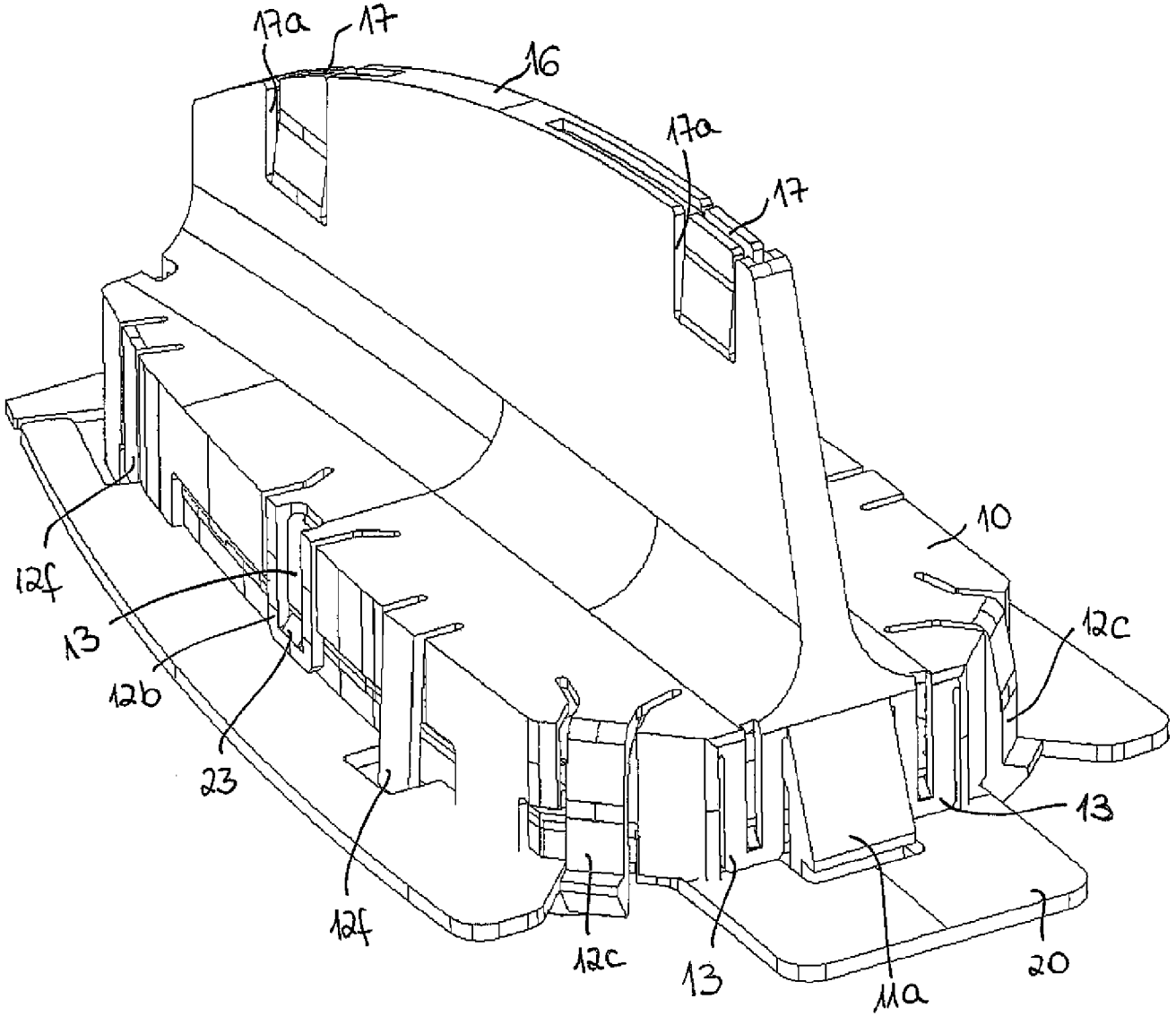
FIG. 9 another view of the vehicle antenna shown in FIG. 8.
Figure 10:
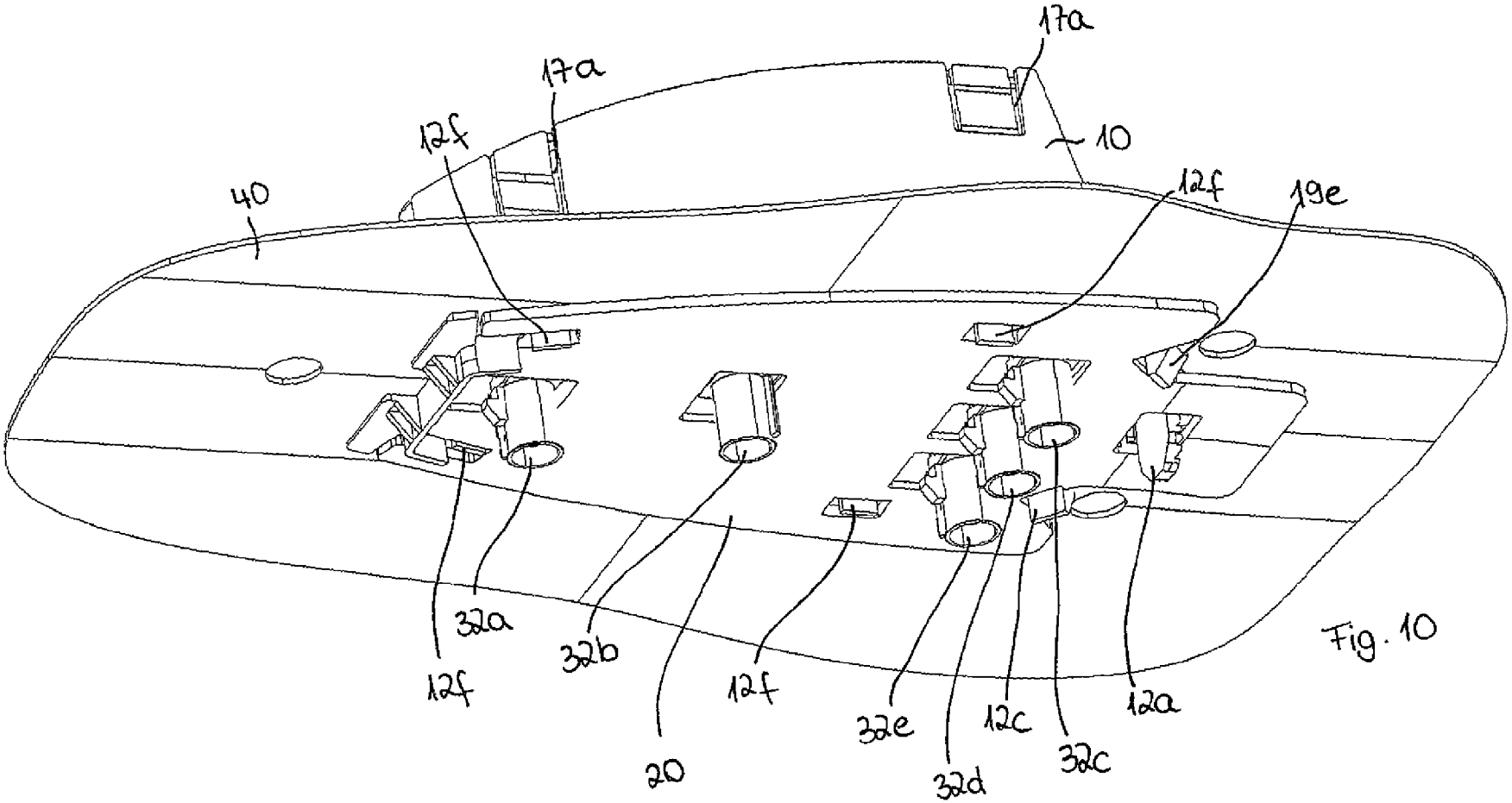
FIG. 10 the vehicle antenna shown in FIG. 8 after mounting on a body part from the bottom.
Figure 11:
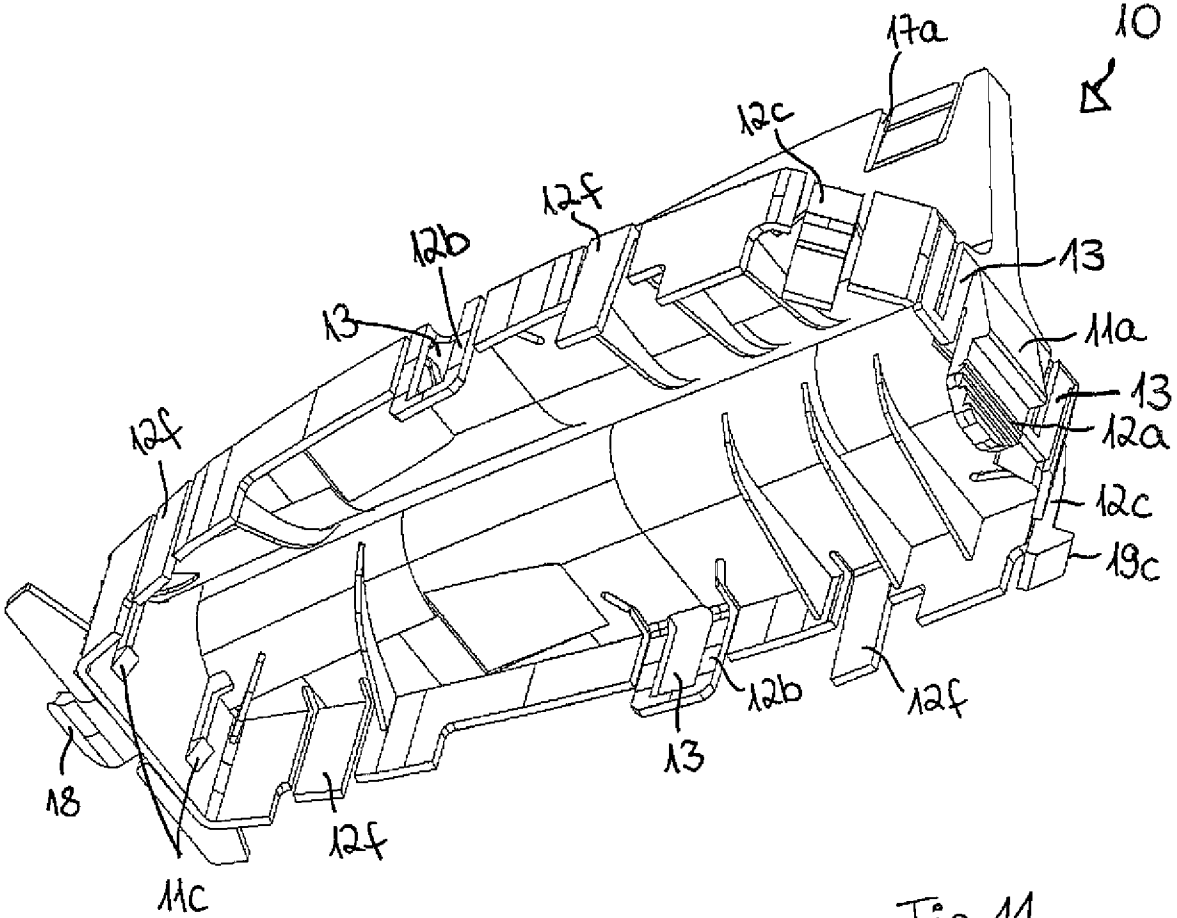
FIG. 11 the top of the vehicle antenna shown in FIG. 8.

FIGS. 8 to 10 show another exemplary embodiment of a vehicle antenna according to the invention; FIG. 11 shows the top of this exemplary embodiment. This exemplary embodiment deviates in some below described details from the exemplary embodiment of FIGS. 1 to 7. Apart from these deviations, the exemplary embodiment corresponds with the above described exemplary embodiment so that reference is made in this respect to the above description.

In contrast to the exemplary embodiment of FIGS. 1 to 7, the vehicle antenna shown in FIGS. 8 to 11 is mounted from the vehicle interior. For this, the clamping strap 18 is first pushed, from the vehicle interior, over the edge of the mounting opening and is put under bending stress in a subsequent swivel movement of the vehicle antenna. In this swivel movement, the bottom part 20 with its strip 21 projecting on both sides is moved towards the underside of the body part, and the top 10 of the antenna is passed through the mounting opening until the latching hook 11*a* of the spring arms 12*a* latches in. The body part is then held between latching hook 11*a* and stops 19*e*.

Due to the reverse mounting direction, the orientation of stops and latching hooks is switched with reference to the exemplary embodiment of FIGS. 1 to 7. Moreover, the fin 16 is beveled on its end facing away from the clamping strap 18.

The spring arm 12*a* carrying the latching hook 11*a* can project through an opening of the bottom part 20, as shown in FIG. 10. This way, latching of the vehicle antenna with the body part can advantageously be loosened by exerting pressure on the end of the spring arm 12*a* transversely to its longitudinal direction, i.e. bending it towards the clamping strap 18.

Mounting the antenna from the vehicle interior enables a repainting of the vehicle roof without dismounting the antenna. Moreover, mounting of the antenna can be done in one operation together with its contacting.

This exemplary embodiment does without stops on the longitudinal sides of the vehicle antenna. Lateral stops 19*b* can also be left out in an exemplary embodiment according to FIGS. 1 to 7 which is set onto a body part from above.

The top 10 of FIGS. 8 to 11 has spring elements 12*f* which engage as centering straps into matching cutouts of the bottom part 20 and facilitate the positioning of the top 10 in relation to the bottom part. For an improvement of the connection between top 10 and bottom part 20, additional latching hooks are attached to the bottom part 20 which engage in slots of the top 10 provided for this.

Figure 12:
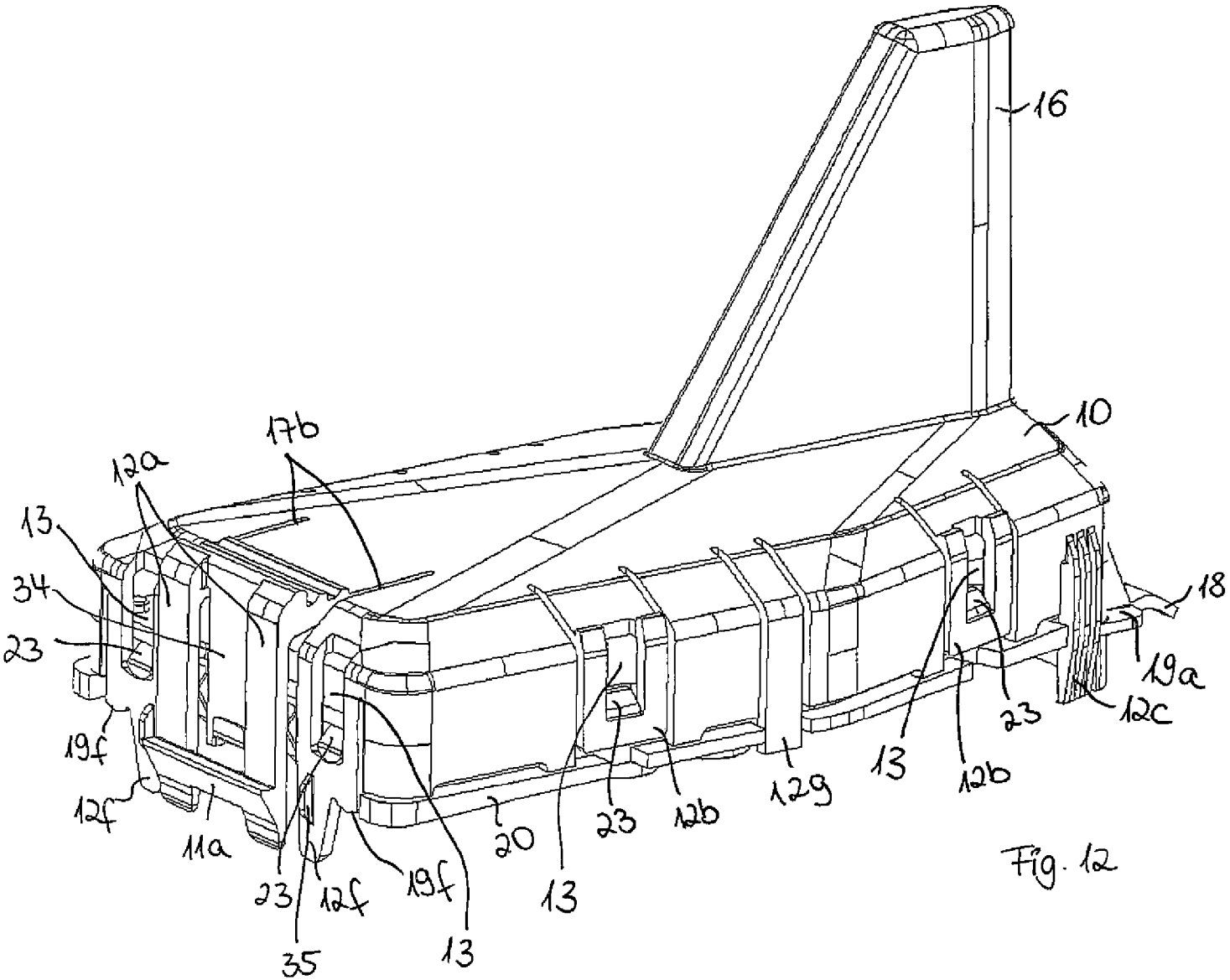
FIG. 12 another exemplary embodiment of a vehicle antenna according to the invention.
Figure 13:
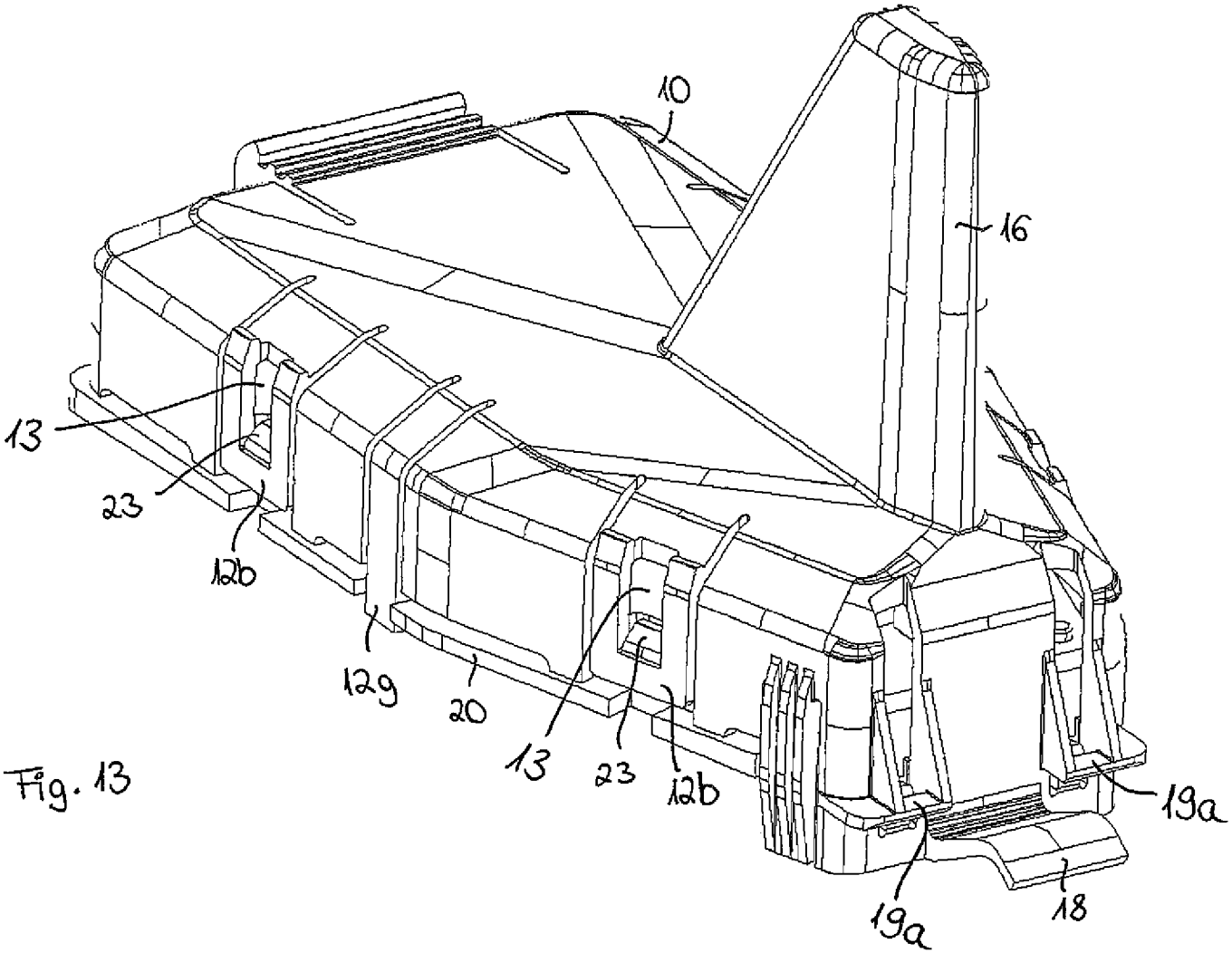
FIG. 13 another view of the vehicle antenna shown in FIG. 12.
Figure 14:
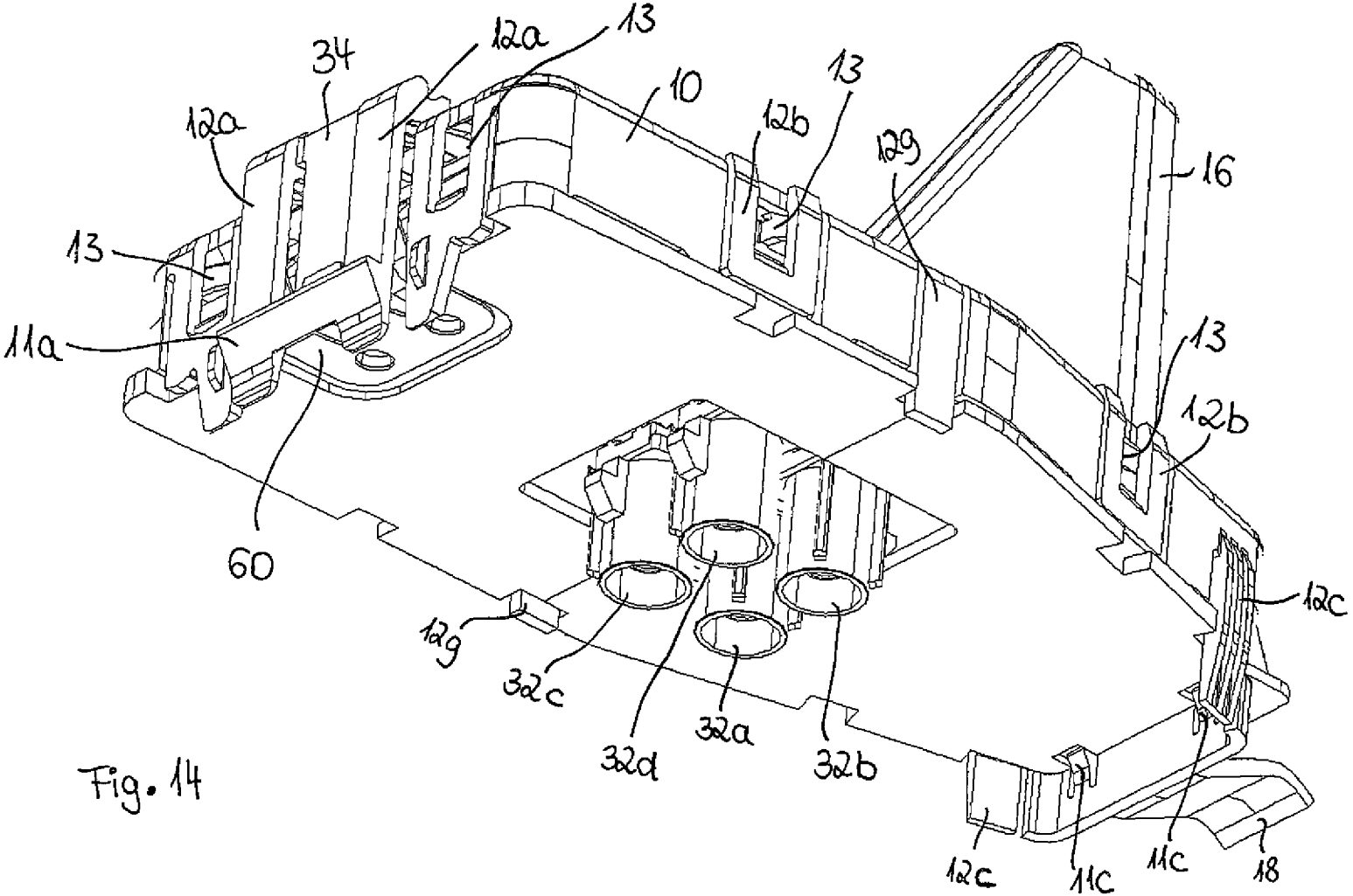
FIG. 14 another view of the vehicle antenna shown in FIG. 12.

FIGS. 12 to 14 show another exemplary embodiment of a vehicle antenna according to the invention. Differences to the above described exemplary embodiments are explained in the following, and reference is otherwise made to the above description.

As with the other exemplary embodiments, the bottom part 20 has a plurality of latching hooks 23 which engage in the latching openings of the top 10. On its two longitudinal sides, the bottom part 20 has two latching hooks 23 each. Two additional latching hooks 23, engaging in openings of spring arms of the top 10, are provided on the end facing away from the clamping strap 18. Additionally, the top 10 can also be provided with latching hooks 11*c* which latch with the bottom part 20. A particularly strong and clatter-free connection can thus be achieved between the top 10 and the bottom part 20.

The vehicle antenna shown in FIGS. 12 to 14 has a somewhat flatter construction than the two other exemplary embodiments. For mounting on a body part, the clamping strap 18 is pushed under the edge of a mounting opening, and with a subsequent swivel movement of the vehicle antenna, the latching hook 11*a* latches into the mounting opening. In mounted condition, the vehicle antenna rests on the body part with spring elements 12*g* formed by indents in the outer wall of the top 10.

The latching hook 11*a* is carried by a spring arm 12*a*. In the exemplary embodiment shown, the spring arm 12*a* is slit in its longitudinal direction so that the hook is carried, so to speak, by two spring arms. Thus can be reduced the mass to be moved for latching in and the force required for bending the spring arm 12*a*. The spring arm 12*a* extends from a section of the upper side of the top 10 limited by indents 17*b* on both sides. This way, the spring arm 12*a* can be pushed downwardly for latching in by pressing on the section on the upper side of the top 10 limited by the indents 17*b*. This enables the problem-free latching of the top 10 into body parts 40 of different sheet metal gauges. So that it is easier to apply this pressure by hand without slipping off, the spring arm or the section delimited by indents 17*b* can be provided with a raise, for example, a bead or a plurality of grooves, knobs, knurling or the like.

A wall section 34 of the top 10 is arranged in the slot of the spring arm 12*a* or, respectively, between the two spring arms 12*a*. The wall section 34 can be reinforced by means of ribs on the inside of the top and rests laterally on the bottom part 20. Moreover, on the side facing the bottom part, the wall section 34 can be provided with a stop which rests on the bottom part as soon as excess pressure is (intentionally or unintentionally) used to press on the area of the spring arm 12*a* delimited by the indents 17*b*. This stop is used as a limitation of the spring path of the spring arm 12*a* and thus protects it from damage (misuse protection).

Next to the spring arm 12*a*, spring elements 12*f* are arranged which sit on the body part 40 with a stop 19*f* and, with spacers 35, rest against the edge of the mounting opening of the body part 40. By means of slopes laterally provided on the spring elements 19*f*, the vehicle antenna is automatically centered while being mounted in the body part which effects, particularly in transverse direction, an effective clearance/tolerance compensation between the joining partners (vehicle antenna and body part).

Figure 15:
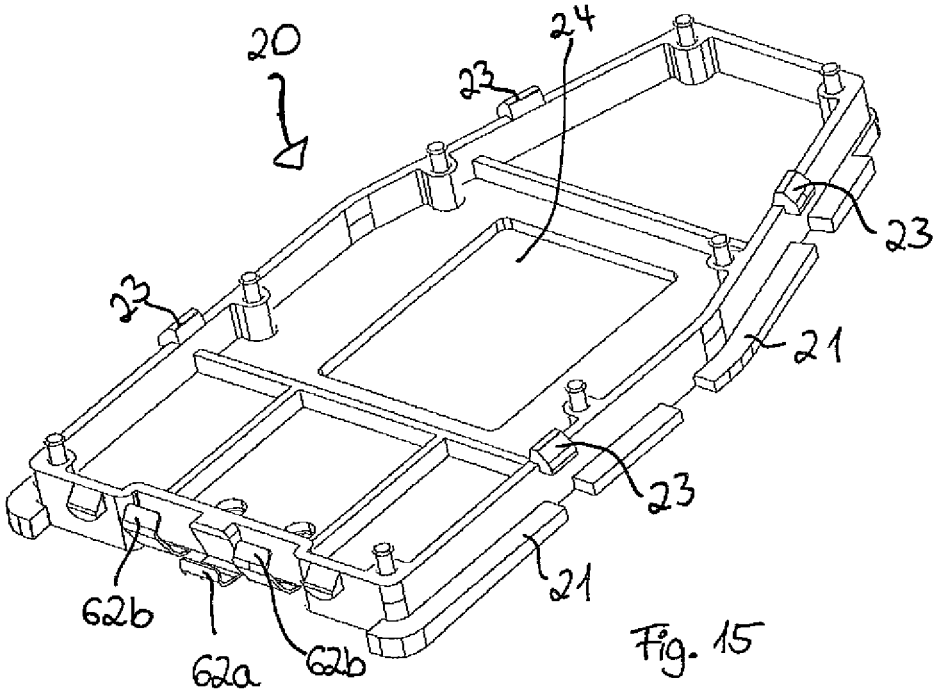
FIG. 15 an exemplary embodiment of the bottom part.
Figure 16:
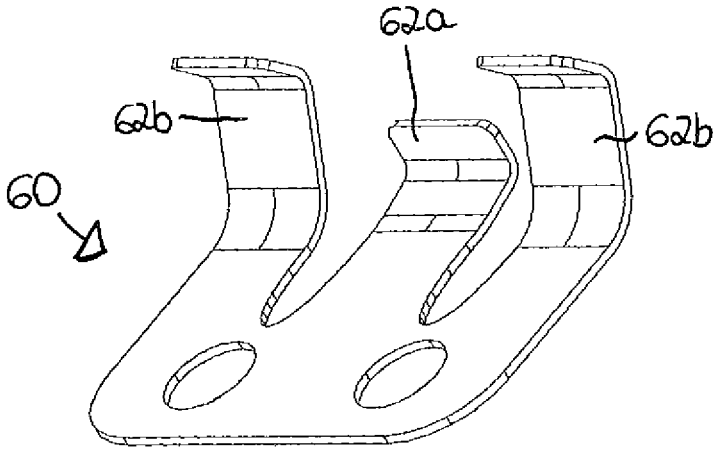
FIG. 16 a sheet spring which is fastened on the bottom plate shown in FIG. 15.

The bottom part 20 may be designed similar to the bottom part shown in FIG. 6. FIG. 15 shows an alternative exemplary embodiment of a bottom part 20. As an additional protection against unlatching on its own, a spring element 60 can be fastened to the bottom part 20. A suitable spring element 60 can be manufactured from sheet metal as a punched bending part, FIG. 16 shows an exemplary embodiment of such a spring element 60.

The spring element 60 is fastened to the bottom part 20, for example by riveting. The spring element shown has lateral spring arms 62*b* which, during the spring deflection of the latching hook 11*a*, exert a counterforce on the spring arm 12*a* and thus counteract any unlatching on its own. Between the lateral spring arms 62*b*, a center spring arm 62*a* can be provided on which rests the wall section 34 of the top 10. When latching the top 10 on the bottom part 20, the center spring arm 62*a* is pushed downwardly and therefore generates a counterforce on the wall section 34. This counterforce effects a support of the material of the top 10 and at the same time increases the clamping force of the antenna in the hole of the body part.

REFERENCE NUMBERS

10 Top
11*a-c* Latching hook
12*a, b* Spring arm
12*c* Spring element
12*d* Clamping wing
12*e* Spring shackle
12*f, g* Spring element
13 Latching element
14 Spring supports
15 Strap
16 Fin
17 Slot
17*a, b* Slitting
18 Clamping strap
19*a-f* Stops
20 Bottom part
21 Strip
22 Positioning element
23 Latching hook
24 Opening
25 Clearance
26 Supporting fields
27*a-c* Hollows
28 Openings
30 Printed circuit board
31*a-d* Radiators
32*a-e* Plug-in connectors
33 Holes
34 Wall section
40 Body part
41 Clearance
50 Cover
60 Spring element
62*a, b* Spring arm

What is claimed is:

1. A vehicle antenna comprising:

a bottom part comprising a metallic base area;

a top latched with the bottom part, and a printed circuit board held between the bottom part and the top and carrying at least one transmission or receiver element, wherein the top has at least one latching hook for latching into a mounting opening of a body part and wherein the top has at least one spring element which, in a mounted condition, laterally pushes against the edge of the mounting opening of the body part.

2. The vehicle antenna according to claim 1, wherein the bottom part laterally extends beyond the top.

3. The vehicle antenna according to claim 1, wherein the bottom part has clearances on its edge.

4. The vehicle antenna according to claim 3, wherein the top engages in clearances on the edge of the bottom part and is latched with the bottom part.

5. The vehicle antenna according to claim 1, wherein the top has at least one latching opening into which engages a latching hook of the bottom part.

6. The vehicle antenna according to claim 1, wherein the top has a stop for abutting the edge of the mounting opening.

7. The vehicle antenna according to claim 6, wherein the stop effects a minimum space between the body part having the mounting opening and an area of the bottom part extending laterally beyond the top.

8. The vehicle antenna according to claim 1, wherein the spring elements are part of a wall of the top (10) and limited by slittings in the top on opposite sides.

9. The vehicle antenna according to claim 1, wherein the top has a slot by means of which a transmission or receiver element is clamped which is carried by the printed circuit board.

10. The vehicle antenna according to claim 1, wherein the printed circuit board is clamped between the bottom part and the top.

11. The vehicle antenna according to claim 1, wherein the top has a clamping strap which is pushed, for mounting, under the edge of the mounting opening and is put under bending stress in a subsequent swivel movement of the vehicle antenna which results in a latching of the at least one latching hook.

12. The vehicle antenna according to claim 1, wherein the bottom part has at least one opening in which a plug-in connector sits which is fastened on the printed circuit board.

13. The vehicle antenna according to claim 1, wherein a plug-in connector has a latching hook for latching with a housing of a matching counterpart, wherein the latching hook sits in or behind the opening so that a counterpart must penetrate into the opening for coupling to the plug-in connector.

14. The vehicle antenna according to claim 1, wherein the top has latching hooks which engage in openings of the bottom part.

15. A vehicle antenna comprising:

a bottom part;

a top latched with the bottom part;

a printed circuit board held between the bottom part and the top and carrying at least one transmission or receiver element;

at least one latching hook attached to the top and configured to latch into a mounting opening of a body part; and at least one stop attached to the top and configured to abut the edge of the mounting opening.

16. The vehicle antenna of claim 15, wherein the bottom part comprises a metallic base area.

17. The vehicle antenna of claim 16, where the at least one stop effects a minimum space between the body part and an area of the metallic base area where the metallic base area forms a capacitive coupling with the body part.

18. The vehicle antenna of claim 17, including at least one insulative strip disposed between the area of the metallic base area and the body part.

19. A vehicle antenna comprising:

a bottom part;

a top latched with the bottom part;

a printed circuit board held between the bottom part and the top and carrying at least one transmission or receiver element;

at least one latching hook attached to the top and configured to latch into a mounting opening of a body part; and a clamping strap attached to the top which is pushed, for mounting, under the edge of the mounting opening and is put under bending stress in a subsequent swivel movement of the vehicle antenna which results in a latching of the at least one latching hook.

* * * * *